US005912401A

United States Patent [19]

Fujii et al.

[11] Patent Number: 5,912,401

[45] Date of Patent: Jun. 15, 1999

[54] PYROMETALLURGICAL SMELTING METHOD OF COPPER

[75] Inventors: Takayoshi Fujii; Susumu Akagi; Yutaka Yasuda; Yoshiaki Suzuki, all of Oita, Japan

[73] Assignee: Nippon Mining & Metals Co., Ltd., Tokyo, Japan

[21] Appl. No.: 08/863,661

[22] Filed: May 27, 1997

[30] Foreign Application Priority Data

May 28, 1996 [JP] Japan ..... 8-133922

[51] Int. Cl.[6] ..... C22B 15/00

[52] U.S. Cl. ..... 75/639

[58] Field of Search ..... 75/639

[56] References Cited

U.S. PATENT DOCUMENTS 4,857,104 8/1989 Victorovich et al. ..... 75/639

5,662,730 9/1997 Akagi et al. ..... 75/639

*Primary Examiner*—Melvyn Andrews

*Attorney, Agent, or Firm*—Kubovcik & Kubovcik

[57] ABSTRACT

In a pyrometallurgical smelting method of copper, the copper-ore and auxiliary fuel, such as carbonaceous material, is blown through an ore-concentrate burner into a reaction shaft. In an improved pyrometallurgical smelting of copper, the carbonaceous material is used to reduce the $Fe_3O_4$ contained in the slag. The present invention provides an improved method for reducing the $Fe_3O_4$ even in a case at a decreased amount of auxiliary fuel is to be decreased. The carbonaceous material is blown into a lower portion of the reaction shaft where the oxygen partial pressure is low.

6 Claims, 6 Drawing Sheets

PYROMETALLURGICAL SMELTING METHOD OF COPPER

BACKGROUND OF INVENTION

1. Field of the Invention

The present invention relates to a pyrometallurgical smelting method of copper, and more particularly to an improvement of a method for charging the carbonaceous material into a flash smelting furnace which is utilized for the pyrometallurgical smelting of copper. Particularly, the present invention is an improvement of the method proposed in U.S. Pat. No. 5,662,730 in the name of Akagi et al.

In the smelting operation of copper, a portion of Fe in the charged materials is over-oxidized to form magnetite ($Fe_3O_4$). This $Fe_3O_4$ deposits on the bottom or side wall of the flash smelting furnace and acts as the protecting layer on the refractories of the furnace but, on the other hand, excess deposition of $Fe_3O_4$ decreases the furnace's inner capacity. When the amount of $Fe_3O_4$ so formed becomes such that excess coating may finally clog tap holes for the slag and matte, the tapping operation is made difficult. In addition, the slag and matte become difficult to separate from one another, and the viscosity of slag is so increased to increase the copper content of the slag.

2. Description of Related Arts

It is a known process in the flash smelting of copper to blow powder coke with or without finely particulated coal together with the copper-ore concentrate and heavy oil into a flash smelting furnace so as to decrease the copper loss in the slag and also to minimize fuel consumption (Japanese Unexamined Patent Publication No. 58-221,241).

It is a general pyrometallurgical-smelting practice of the flash smelting furnace that heavy oil, powder coke, finely particulated coal or the like are blown, as auxiliary fuel for heat compensation, together with the ore into the reaction shaft of the flash smelting furnace. The powder coke, finely particulated coal or the like is blown in U.S. Pat. No. 5,662,730 not only for the heat compensation but also for the reduction of $Fe_3O_4$. Namely, a portion of the solid carbonaceous material added is not burnt in the reaction shaft but covers the melt in the reaction shaft's bottom, or alternatively the carbonaceous material is so finely particulated as to intrude into the melt in the reaction shaft's bottom.

In the copper flash-smelting practice with the addition of carbonaceous material, the air blast may be oxygen-enriched along with increase in the ore-feeding rate, or, alternatively, a high-S grade ore, S of which is the main fuel, is processed to prevent troubles in the furnace operation. In these cases, the thermal load applied to the flash smelting furnace, particularly the reaction shaft, becomes so increased that the amount of auxiliary fuel for heat compensation is decreased or becomes unnecessary. This indicates that, when a flash smelting furnace is operated under the conditions as described above, the amount of powder coke or particulated coal capable of addition into the reaction shaft is limited. This, in turn, means that the amount of carbonaceous material, which participates in the reduction of excess $Fe_3O_4$, decreases, and the amount of $Fe_3O_4$ in the slag accordingly increases. Various operational troubles described above are, therefore, incurred, and the copper loss in the slag increases.

In the pyrometallurgical smelting method proposed in U.S. Pat. No. 5,662,730, the carbonaceous material, whose grain size is under 100 $\mu$m and is in a proportion of 65% or more, and whose grain size is from 44 to 100 $\mu$m and is in a proportion of 25% or more, and which has 80% or more of fixed carbon content, is preliminarily mixed with the main charging material and is charged into a reaction shaft of a flash smelting furnace through an ore-concentrate burner. Alternatively the carbonaceous material is charged by means of a burner for exclusive use. In this method, although from 40 to 80% of the carbonaceous material is burnt in the reaction shaft, the unburnt coke has a small grain size, collides on and is captured by the molten particles of the copper-ore concentrate which simultaneously fall down through the reaction shaft. The captured carbonaceous material intrudes into the slag bath formed in the lower portion of the reaction shaft and then floats on the surface of the slag bath. Until the carbonaceous material floats onto the surface of the slag bath, the contact reduction of $Fe_3O_4$ with the carbonaceous material occurs. By positively utilizing the contact reduction, the $Fe_3O_4$ can be effectively reduced without incurring such troubles as excess reduction due to unburnt carbonaceous material, which floats and stagnates on the slag bath, and post-burning of unburnt carbonaceous material which scatters into a waste-heat boiler.

However, since the method proposed in U.S. Pat. No. 5,662,730 involves charging the carbonaceous material from the top of the reaction shaft, from 40 to 80% of the carbonaceous material is burnt in the reaction shaft and contributes to heat compensation as the auxiliary fuel. Therefore, when the amount of auxiliary fuel must be decreased along with increase in the feeding rate of the copper-ore concentrate, the amount of auxiliary fuel charged from the top of the reaction shaft must be accordingly decreased. As a consequence, the reduction amount of $Fe_3O_4$ in the lower portion of the reaction shaft decreases, and the content of $Fe_3O_4$ in the slag increases. Various troubles are, therefore, incurred.

SUMMARY OF INVENTION

It is, therefore, an object of the present invention to provide a pyrometallurgical smelting method of copper, in which the carbonaceous material can be loaded, without increasing the thermal load of a flash smelting furnace operated even under a state of high charging of ore, thereby maintaining trouble-free operation.

In accordance with the objects of the present invention, there is provided a pyrometallurgical method of copper in a flash smelting furnace comprising a reaction shaft provided with an ore-concentrate burner and a settler below said reaction shaft, said method comprising the steps of:

charging copper-ore concentrate through the ore-concentrate burner;

falling said copper-ore concentrate through the reaction shaft and forming a melt bath in the settler; and, blowing at least a portion of the carbonaceous material into a lower portion of the reaction shaft where the oxygen partial pressure is low, thereby preventing said portion of the carbonaceous material from burning in the furnace and capturing said portion of the carbonaceous material by the matters falling through the reaction shaft. Preferably, the grain size of the carbonaceous material is under 100 $\mu$m in a proportion of 65% or more and is under 44 $\mu$m in a proportion of 30% or more.

The present invention is hereinafter described in detail.

BRIEF DESCRIPTION OF DRAWINGS

The combustion speed of the carbonaceous material added in a reaction shaft is influenced by the oxygen partial pressure in the shaft, temperature of coke particles, flow speed of gas and the like. How these parameters vary in the reaction shaft can be predicted based on a mathematical model, i.e, the flash-smelting furnace model as shown, for example, in FIG. 1. Since the copper concentrate, which is self-burning and charged together with the carbonaceous material, is in a predominant amount compared with the other materials, the oxygen partial-pressure ($Po_2$) in the reaction shaft is ruled by combustion of the copper concentrate and drastically decreases toward the reactor bottom as shown in FIG. 1. In FIG. 1, $U_p/U_g$ is the flow rate (U) ratio of particles/gas. $T_p$ is temperature (K) of particles. $t_p$ is the falling time (sec) of particles. With regard to three kinds of powder coke, whose distribution of grain size is shown in FIG. 2, their combustion behavior in a reaction shaft is considered. The distribution of grains sizes of the respective powder cokes is as follows.

TABLE 1

| | Under 100 μm | 100 μm – 44 μm |
|---|---|---|
| Powder coke 1 | 78% | 63% |
| Powder coke 2 | 49% | 41% |
| Powder coke 3 | 7% | 5% |

Figure 1:
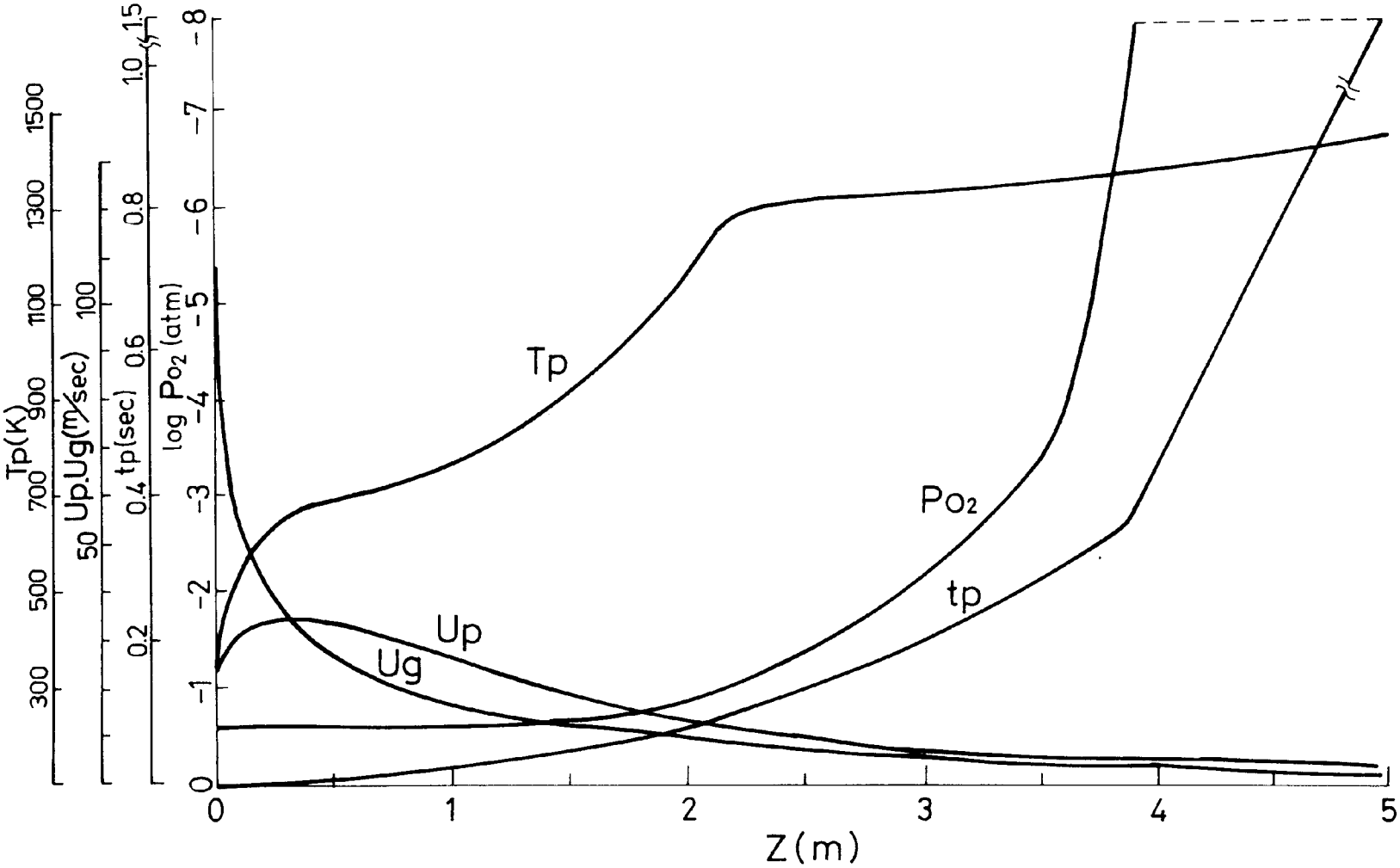
FIG. 1 is a graph showing the results of predicting how the respective parameters vary in a reaction shaft, based on a mathematical model.
Figure 2:
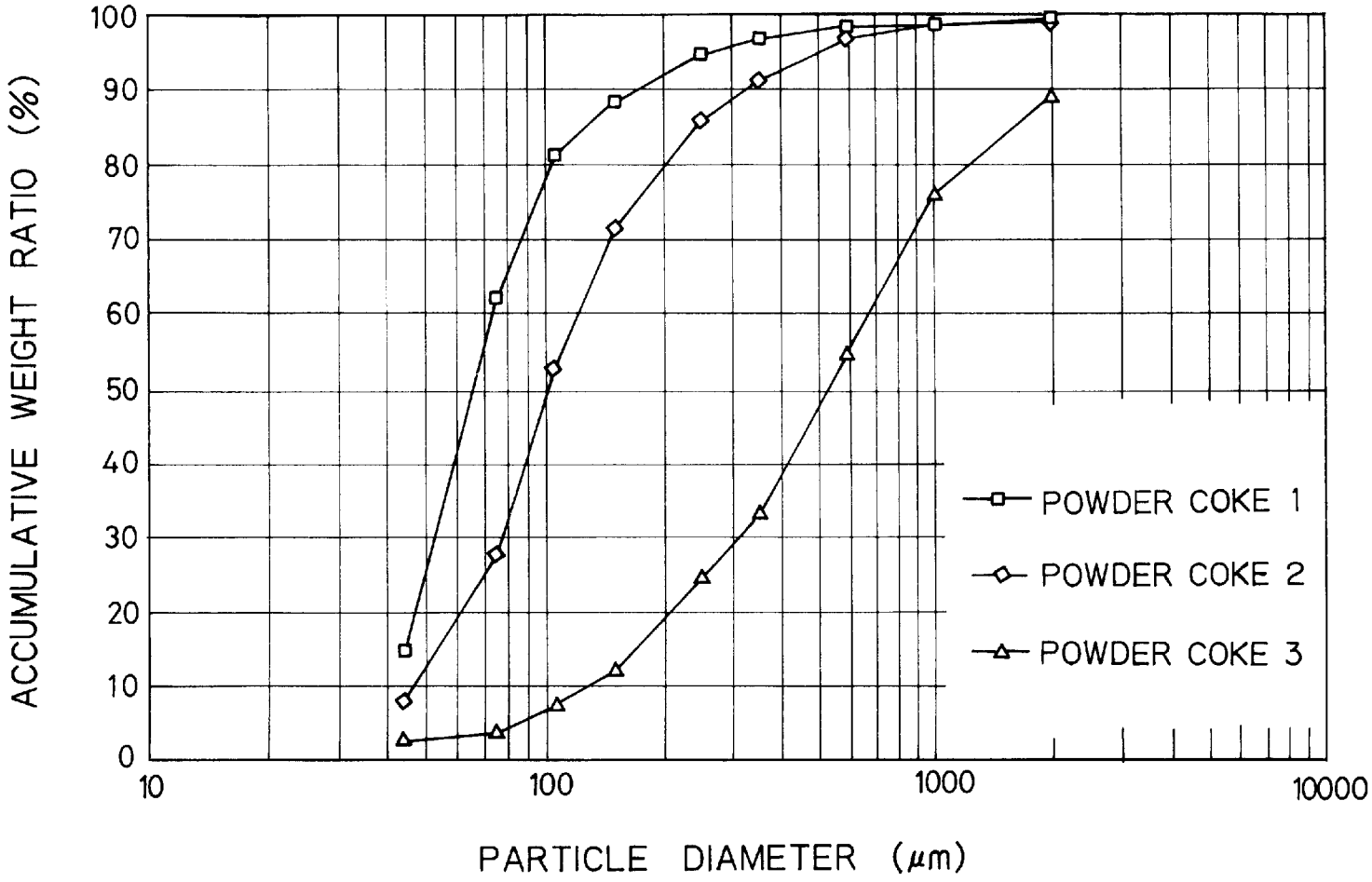
FIG. 2 is a graph showing the distribution of powder coke, obtained as a result of predicting the burning ratio.
Figure 3:
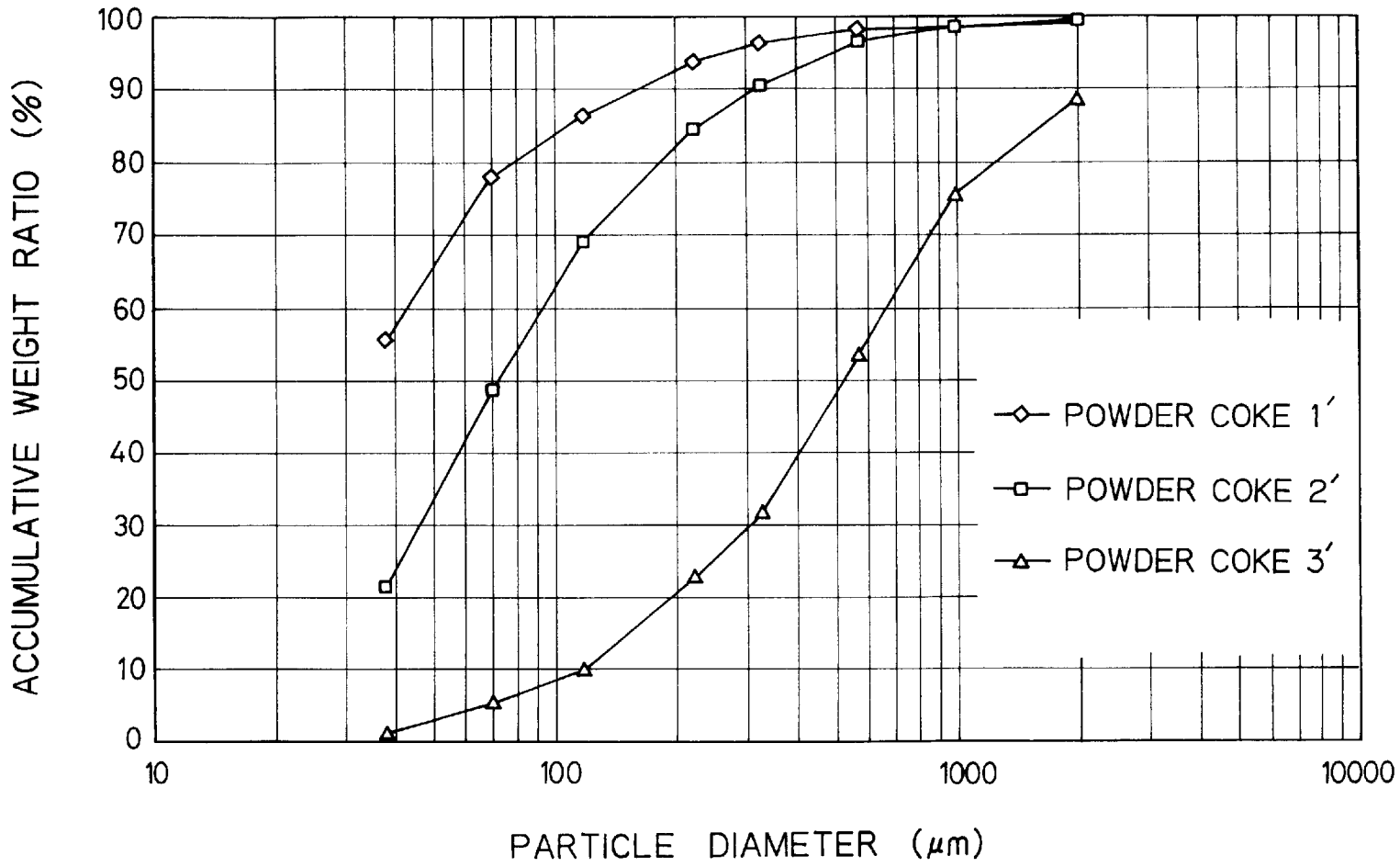
FIG. 3 is a graph showing the distribution of the grain size of the unburnt coke at the lowest portion of a reaction shaft.

The combustion ratio of the powder coke with three different grain-size distributions, as shown in FIG. 2, being burnt in a reaction shaft was predicted by the following calculation and on the basis of varying parameters as shown in FIG. 1. The results are shown in Table 2. The particle diameter of after-burning carbonaceous material can be calculated by the following formula.

$$r=r_0-(M_c/P_c)\times k_t\times C(O_2)\times\theta.$$

r: radius of the carbonaceous particle after burning (m)

$r_0$: initial radius of the carbonaceous particle (m)

$M_c$: molecular weight of carbon, 0.012 kg/mol $P_c$: density of the carbonaceous particles, 1000 kg/m$^3$ $k_t$: constant of total reaction rate (m/hr)

$C(O_2)$: oxygen concentration (mol/Nm$^3$)

θ: reaction time (hr)

The constant of total reaction rate was derived from the method described in Exercise of Smelting Chemical Engineering (written and edited by Iwao Muchi, Jan. 15, 1974, published by Yokendo, First Edition), pages 25 through 30, particularly the method described in pages 28 through 31. It is intended in this Exercise to predict by the above calculation method the combustion speed of a carbon particle during the sintering process. This method is based on the hypothesis that: the carbon is a single particle; the initial outer diameter of the carbon particle is maintained by the ash layer; and the diffusion resistance in the ash layer is negligible, i.e., only the diffusion resistance of the gas boundary film and the resistance of chemical reactions are taken into consideration. The hypothesis is considered to be practically reasonable also in the case of predicting combustion of carbon particles in a flash smelting furnace. The origin of the post burning radius (r) is also in the above Exercise, page 30.

TABLE 2

Prediction Results of Combustion Ratio (%) of Powder Coke in a Reaction Shaft

| | Calculated Value | Measured Value |
|---|---|---|
| Powder Coke 1 | 74 | 55–80 |
| Powder Coke 2 | 59 | 40–67 |
| Powder Coke 3 | 17 | 10–30 |

An aperture for sampling is provided in the lowest position of the side wall of a reaction shaft so as to collect the materials falling through the reaction shaft. The so-called samples of the falling materials were analyzed with regard to the carbon content. The measured results are shown in Table 2, together with the calculated value. The two values are in good agreement. As is clear from Table 2, as the grain-size distribution of the charged powder coke is coarser, the combustion ratio becomes lower, that is, the proportion of unburnt powder coke becomes greater. Since the calculation based on a model is in good agreement with the measured value, consideration was given, relying on the mathematical model, to the grain-size distribution of powder coke, which is unburnt and remains in the furnace.

The change of oxygen partial pressure in the flash smelting furnace shown in FIG. 1 is predicted based on the mathematical model. The oxygen partial pressure ($Po_2$) is high and changes only slightly in the upper portion of a reaction shaft from the top to approximately 2 meters. The carbonaceous material cannot, therefore, be prevented from burning as long as it is charged from the top of the reaction shaft.

Contrary to this, the oxygen partial pressure ($Po_2$) lowers drastically in the lower portion of the reaction shaft. In addition, the carbonaceous material with small diameter, unburnt in the reaction shaft collides with and is captured by the molten particles of the copper-ore concentrate falling down through the reaction shaft. The carbonaceous material then intrudes into the slag bath and reduces $Fe_3O_4$. The present inventors paid attention to these facts and arrived at the invention.

Therefore, the carbonaceous material is blown into a lower portion of the reaction shaft, where the oxygen partial pressure ($Po_2$) is extremely low, for example less than −1 in terms of log $Po_2$, and the carbonaceous material is not burnt in the reaction shaft but is captured by the molten particles of the copper-ore concentrate. The carbonaceous material then intrudes into the slag bath and reduces $Fe_3O_4$. Therefore, almost all of the carbonaceous material can contribute to the reduction of $Fe_3O_4$. This, in turn, leads to prevent excess $Fe_3O_4$-formation in the slag during operation of a flash smelting furnace, even if the charging amount of carbonaceous material is decreased.

Figure 4:
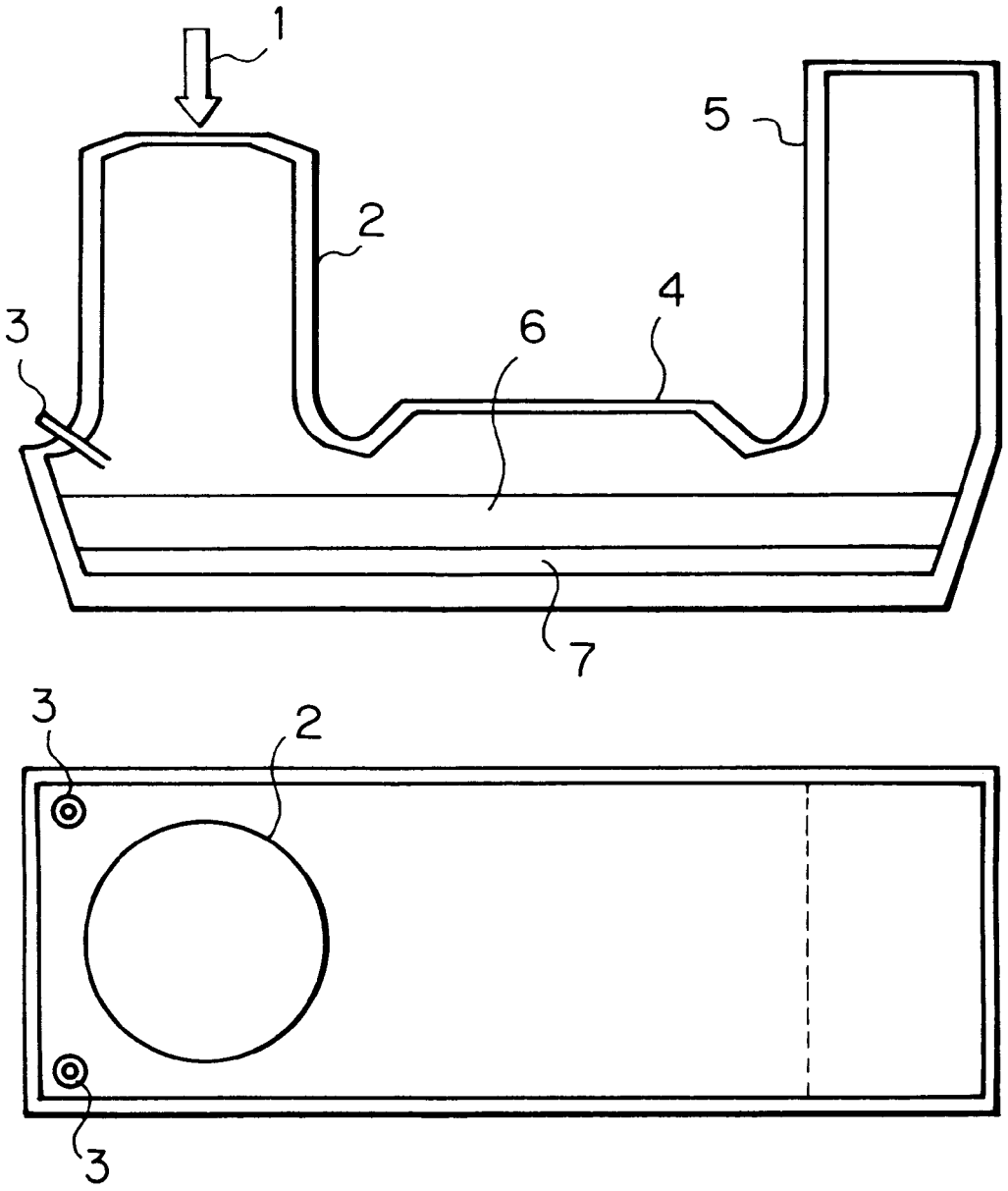
FIG. 4 illustrates a flash smelting furnace used in the example.

Referring to FIG. 4, a flash smelting furnace for implementing the method according to the present invention is illustrated. A blowing conduit of carbonaceous material is inserted into a lower portion of the flash smelting furnace at the position shown in FIG. 4. An aperture is provided through the settler roof at a corner below the reaction shaft 2, for inserting a blowing conduit 3 therethrough and directing it toward a zone, where the molten particles of copper-ore concentrate fall down through the reaction shaft 2. The carbonaceous material is blown with the aid of gas which essentially brings about neither burning of the carbonaceous material nor combustion of itself in the reaction shaft. Preferably, the blowing gas is a non-oxidizing gas, such as nitrogen.

Principally, the blowing position of the carbonaceous material may be such that the front end of the blowing conduit coincides with the side wall of a lower portion of the reaction shaft, because the oxygen partial pressure is low in the lower portion of a reaction shaft. However, the inner wall of the reaction shaft has a temperature of 1200° C. or higher, and, an aperture through the side wall may be clogged by the ore particles which deposit and melt on the side wall. The carbonaceous material cannot be blown for an extended period through a blowing conduit opened at the side wall. A blowing conduit is, therefore, preferably such that it protrudes into the reaction shaft.

It is advantageous that there are as many blowing apertures for carbonaceous material as possible so as to disperse the carbonaceous material. The apertures may, therefore, be uniformly arranged circumferentially around the reaction shaft. This arrangement is, however, not preferable, because the gas flows from the upper to lower portion of a reaction shaft 2, while gas also flows from the settler 4 toward the uptake 5. Therefore, when the carbonaceous material is blown from the uptake side of the reaction shaft 2, the carbonaceous material is blown against the gas flow in the flash smelting furnace, with the result that the capturing of carbonaceous material by the molten particles of copper-ore concentrate may be impeded. This problem does not arise in the case of blowing conduit 3 shown in FIG. 4, because its position is away from directly beneath the reaction shaft 2, and further, the blowing conduit 3 protrudes through the settler roof. The number of blowing conduits, which is two in FIG. 4, is not limited at all, provided that the above described problems are avoided. The position of blowing conduits is, also, not at all limited to that shown in FIG. 4.

The composition of the carbonaceous material need not be limited, in a case where there is no necessity, from the point of view of heat balance, to decrease the amount of auxiliary fuel charged from the reactor top. On the other hand, in a case where the amount of auxiliary fuel is limited or no auxiliary fuel is used at all because the ore-charging rate is increased, a preferable carbonaceous material is such that the content of fixed carbon required for the reduction of $Fe_3O_4$ must be high, while the content of volatile matters, which are burnt and thus do not participate in the reduction of $Fe_3O_4$, must be small.

Next, regarding the grain size of carbonaceous material, it should be such that effective reduction of $Fe_3O_4$ is attained. Specifically, the carbonaceous material is to be captured by the molten particles of the copper-ore concentrate falling down through the reaction shaft and intrudes into the slag layer. When the grain size of carbonaceous material is very coarse, the carbonaceous material floats and stagnates on the slag layer, and forms a strong reducing atmosphere in the furnace interior, so that such troubles as disappearance of the refractory $Fe_3O_4$ coating and even erosion of the refractory lining disadvantageously arise. Several of the present inventors already proposed in U.S. Pat. No. 5,662,730 the grain size which does not incur the above described troubles, but can attain effective reduction of $Fe_3O_4$ in the slag.

Figure 5:
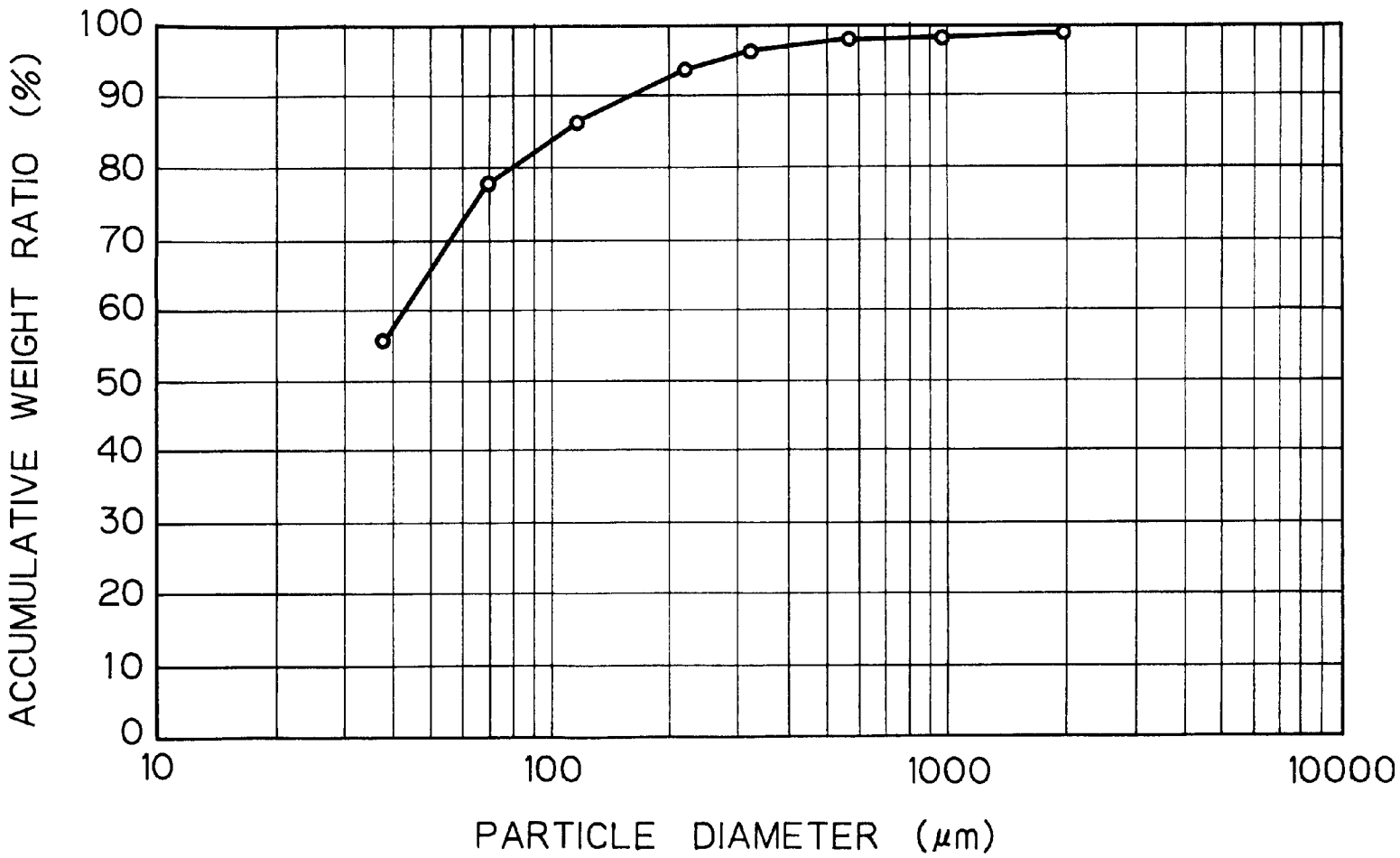
FIG. 5 is a graph showing the relationship of weight ratio versus the grain size of unburnt coke at the lowest portion of a reaction shaft.

FIG. 5 illustrates a predicted distribution of grain size of carbonaceous material unburnt in a lower portion of the reaction shaft. A preferable grain size of the carbonaceous material blown into a lower portion of the reaction shaft is under 100 $\mu$m in a proportion of 65% or more and is under 44 $\mu$m in a proportion of 30% or more, more preferably under 100 $\mu$m in a proportion of 80% or more and is under 44 $\mu$m in a proportion of 50% or more.

The carbonaceous material, which may not be captured by the molten particles of the copper-ore concentrate falling down through the reaction shaft, falls onto and floats on the slag layer below the reaction shaft. The carbonaceous material displaces toward the uptake side, because it is blown downstream over the settler. The molten particles of the copper-ore concentrate, which fall down on the slag layer through the reaction shaft, force the carbonaceous material to intrude into the surface of the slag layer. During the displacement and floating, the reduction of $Fe_3O_4$ occurs. Virtually all of the blown carbonaceous material can, therefore, contribute to the reduction of $Fe_3O_4$. Therefore, the reducing effects attained by the present invention are equal to that attained by the method of U.S. Pat. No. 5,662,730, in which the carbonaceous material is preliminarily charged with the main charging materials and is then charged through an ore-concentrate burner into the reactor top of a flash smelting furnace, thereby intruding the unburnt carbonaceous material into the slag layer.

The present invention is described with reference to an example.

EXAMPLE

A flash smelting furnace was operated under the feeding rate of the main charging materials such as ore and flux, amounting to 65 t/h, and the feeding material of carbonaceous material as the auxiliary material amounting to 240 kg/h. The latter rate was at a low level because the S content of the raw materials was increased. The flash smelting furnace was provided with two blowing conduits as shown in FIG. 4, in the settler corner. From each blowing conduit was blown 120 kg/h of the carbonaceous material into the lower portion of the reaction shaft with the aid of nitrogen gas. The total blowing rate was, therefore, 240 kg/h. The addition ratio of carbonaceous material relative to the ore charged into the flash smelting furnace corresponds to 0.37%.

The $Fe_3O_4$ content of the slag, which is an index of the reduction effect, was from 3 to 6%, indicating satisfactory reducing ability of the carbonaceous material. The copper loss in the slag was 0.6%. Observation of the furnace interior revealed that almost no unburnt carbonaceous material floats on the surface of the bath in a settler. No after burn trouble in the boiler occurred at all, which indicates good operation of a flash smelting furnace.

Figure 6:
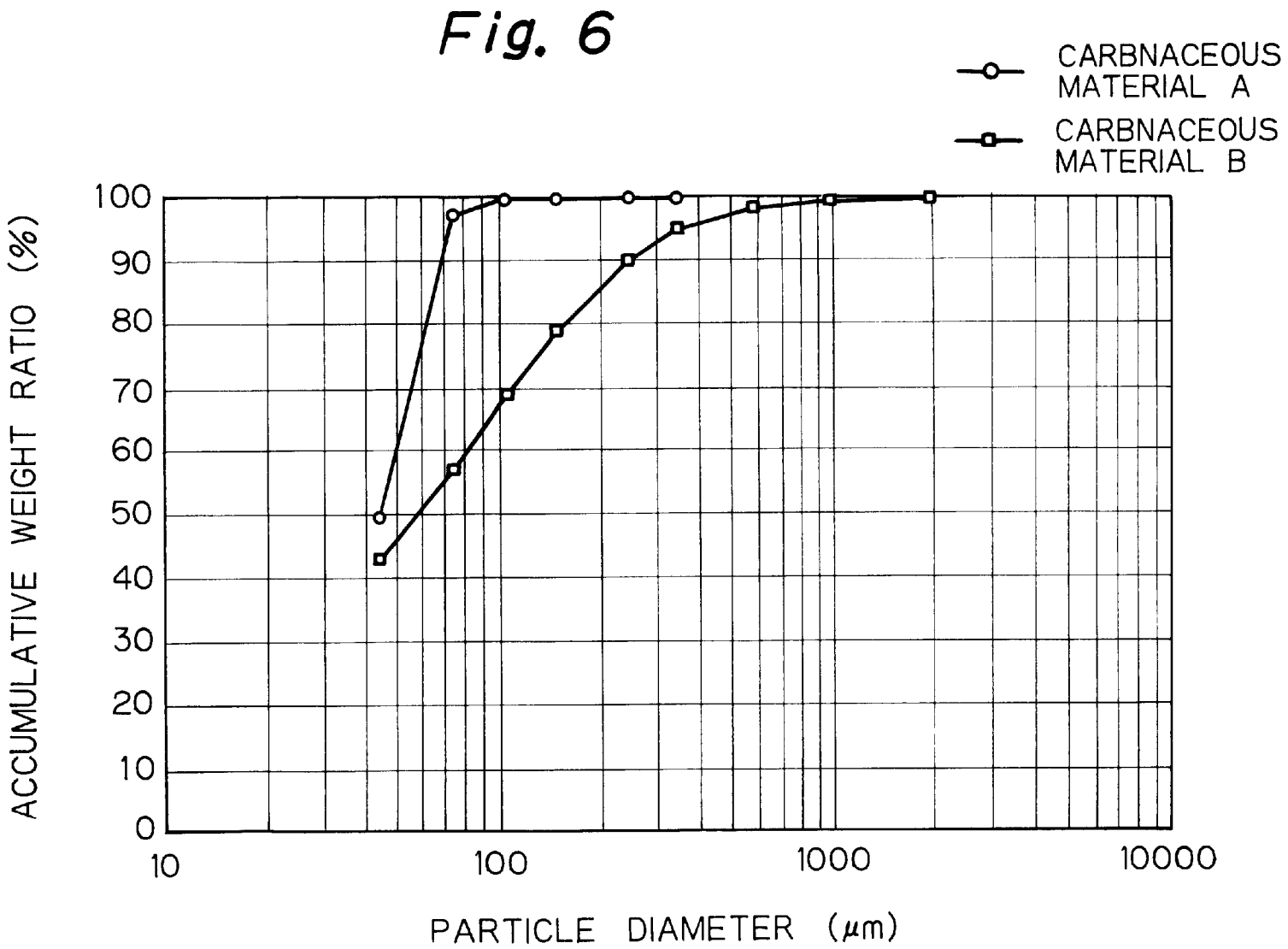
FIG. 6 is a graph showing the distribution of grain sizes of the powder coke used in the examples.

For comparison purpose a flash smelting furnace was operated under the feeding rate of the main charging materials such as ore and flux, amounting to 65 t/h, and the feeding material of carbonaceous material as the auxiliary material amounting to 240 kg/h. The flash smelting furnace was not provided with two blowing conduits as shown in FIG. 4. The carbonaceous material B, which had the grain distribution as shown in FIG. 6 and the fixed carbon content of 82%, was mixed in the main charging material, so that the addition amount of carbonaceous material amounted to 0.4%. The mixed, main charging material and carbonaceous material were charged into a flash smelting furnace through an ore-concentrate burner. The total charging rate of carbonaceous material was 260 kg/h. The $Fe_3O_4$ content in the slag was as high as 8–10%, and the copper loss in the slag was as high as 0.65–0.75%.

As is described hereinabove, when the carbonaceous material is added into the lower portion of a flash smelting furnace by the claimed method, the addition amount of carbonaceous material can be reduced considerably as compared with the method of adding into the top of a flash smelting furnace. It is, therefore, possible even in the case of a high-load operation of a flash smelting furnace, to prevent the excess formation of $Fe_3O_4$ in the slag without increasing the heat load to the reaction tower. Trouble-free operation of a flash smelting furnace can, therefore, be maintained.

We claim:

1. A method for pyrometalurgical smelting of copper in a flash smelting furnace comprising a reaction shaft provided with an ore-concentrate burner and a settler having a roof and provided below said reaction shaft, said method comprising the steps of:

charging a copper-ore concentrate through the ore-concentrate burner to form molten particles of the copper-ore concentrate that fall through the reaction shaft and form a melt bath and a slag layer in the settler; and charging a finely divided carbonaceous material into said flash smelting furnace wherein at least a portion of the carbonaceous material is blown into a lower portion of the reaction shaft where oxygen partial pressure ($Po_2$) is low, whereby said portion of the carbonaceous material does not burn in the reaction shaft and is captured by the molten particles of the copper-ore concentrate falling through the reaction shaft.

2. A pyrometallurgical method according to claim 1, wherein the grain size of the carbonaceous material is under 100 $\mu$m in a proportion of 65% or more and is under 44 $\mu$m in a proportion of 30% or more.

3. A pyrometallurgical method according to claim 1 or 2, wherein all of the carbonaceous material charged into said flash smelting furnace is blown into the lower portion of the reaction shaft.

4. A pyrometallurgical method according to claim 3, wherein a blowing conduit which protrudes through the roof of the settler is provided and the carboneous material is blown through said blowing conduit.

5. A pyrometallurgical method according to claim 4, wherein the blowing conduit is directed to the surface of a slag layer formed on the settler.

6. A pyrometallurgical method according to claim 4, wherein the oxygen partial pressure in the lower portion is less than approximately −1 atm in terms of log $Po_2$.

* * * * *